US005280763A

United States Patent [19]

Spanier et al.

[11] Patent Number: 5,280,763

[45] Date of Patent: Jan. 25, 1994

[54] APPARATUS FOR TENSIONING A SAIL

[75] Inventors: Barry Spanier, Kahului; Nils Rosenblad, Maui, both of Hi.

[73] Assignee: Neil Pryde Limited, Tuen Mun, Hong Kong

[21] Appl. No.: 830,830

[22] Filed: Feb. 4, 1992

[51] Int. Cl.[5] ..... B63H 9/04

[52] U.S. Cl. ..... 114/103; 114/102

[58] Field of Search ..... 114/102-108; 248/354.1, 354.6, 354.7, 188.6; 160/70; 135/89; 16/327, 328

[56] References Cited

U.S. PATENT DOCUMENTS

| | | | |
|---|---|---|---|
| 1,362,950 | 12/1920 | Ljungstrom | 114/103 |
| 1,609,821 | 12/1926 | Ibold | 160/70 |
| 1,742,234 | 1/1930 | Clifton | 160/70 |
| 2,831,447 | 4/1958 | Hanna | 114/102 |
| 4,700,921 | 10/1987 | Holbrook | 248/188.6 |
| 5,012,755 | 5/1991 | Lockhard | 114/103 |
| 5,065,685 | 11/1991 | Stevenson | 114/102 |

*Primary Examiner*—Robert J. Oberleitner
*Assistant Examiner*—Clifford T. Bartz
*Attorney, Agent, or Firm*—Gunn, Lee & Miller

[57] ABSTRACT

A sail tensioning device comprises a handle 70, an arm 73 and a tube 75 which fit together to form the device. The handle is fixed by a strip of webbing which fits in an opening 77 and is stitched to a sail to provide an anchor for the handle. The arm 73 fits in a cavity in the handle 70 to pivot about an intermediate point of the handle and urge the tube 76 against a batten (not shown), as the handle swivels about the anchor. Urging the batten in this way forces the batten against a remote end of a batten pocket to tension the sail.

17 Claims, 4 Drawing Sheets

APPARATUS FOR TENSIONING A SAIL

The present invention relates to apparatus for tensioning a sail. The invention is particularly applicable to sails for sail boards or windsurfers, but may be used with other sails, such as for hangliders and sailing boats.

In order to create and stabilize the aerodynamic shape of a sail, it is known to insert a batten into a pocket on the sail. The pocket generally extends from the trailing edge of the sail. The pocket is open at one end, on an edge of the sail, and the batten is forced into the pocket by means of a strap on the sail which cooperates with a friction buckle at the open end of the pocket to hold the batten in the pocket and so tension the sail along the length of the pocket. The batten and pocket may extend across the full width of the sail. A drawback of this system is that it results in having a strap hanging loose at the trailing edge of the sail and, to ensure adequate batten length for tensioning the sail as it stretches through use, the batten is made significantly longer than the pocket and hence projects beyond the sail edge. The protruding batten and flapping strap are unsightly and also create drag which reduces the efficency of the sail.

A further proposal has been made in GB Application 2220630A where a batten is provided in which the effective length of the batten can be adjusted and the batten sprung into a batten pocket. In that arrangement and in the other earlier arrangements, it is still a problem to readily or easily apply and release the tension in the sail as desirable and when fitting and removing the battens as normally required before and after using the sail.

It is an object of the invention to at least reduce this problem.

According to the invention there is provided tensioning apparatus for a sail comprising an elongate pocket closed at one end, a batten housed in the pocket, a collapsible hinged lever mechanism anchored to the sail adjacent the other end of the pocket arranged to lock and press the batten longitudinally towards the one end of the pocket to tension the sail.

The pocket may have a closable opening along its length for insertion of the batten.

The pocket may be formed by an elongate strip of material attached to the sail to form the pocket therebetween or a region of overlapping said panels.

The mechanism may comprise two link parts hinged together with one end link anchored to the sail and the other end arranged to press towards the batten whenever the links are aligned with one another to tension the sail.

Locking arms may be included to releasably lock the links when in alignment and prevent them hinging about one another.

The mechanism may include a central bar which is aligned with and at one end of the batten and over which bar the locking arms engage.

The mechanism may include a bar generally aligned with and having its first end at one end of the batten, a hinged connection between the other end of the bar and an intermediate part of a handle which is hinged to pivot about its end anchored to the sail, whereby when the handle is swung towards the sail the bar is moved to urge the batten towards the other end of the pocket.

Preferably the bar and the handle are arranged to be completely separable from one another and to fit securely together only when the tension is to be applied.

An embodiment of the invention may comprise tensioning apparatus for a sail comprising a collapsible hinged lever mechanism which is arranged to be anchored to the sail adjacent one end of a batten pocket which is closed at one end and open at the other end, the mechanism being movable manually between first and second operative positions, in which in the first position the apparatus is loosely adjacent one end of the batten and in the second position the apparatus presses axially and firmly against the one end of the batten to urge the batten against the one end of the pocket and tension the sail.

Other preferred features and advantages of the invention will the apparent from the following description and the accompanying claims.

The invention will be further described by way of example, with reference to the accompanying drawings, in which.

Figure 1:
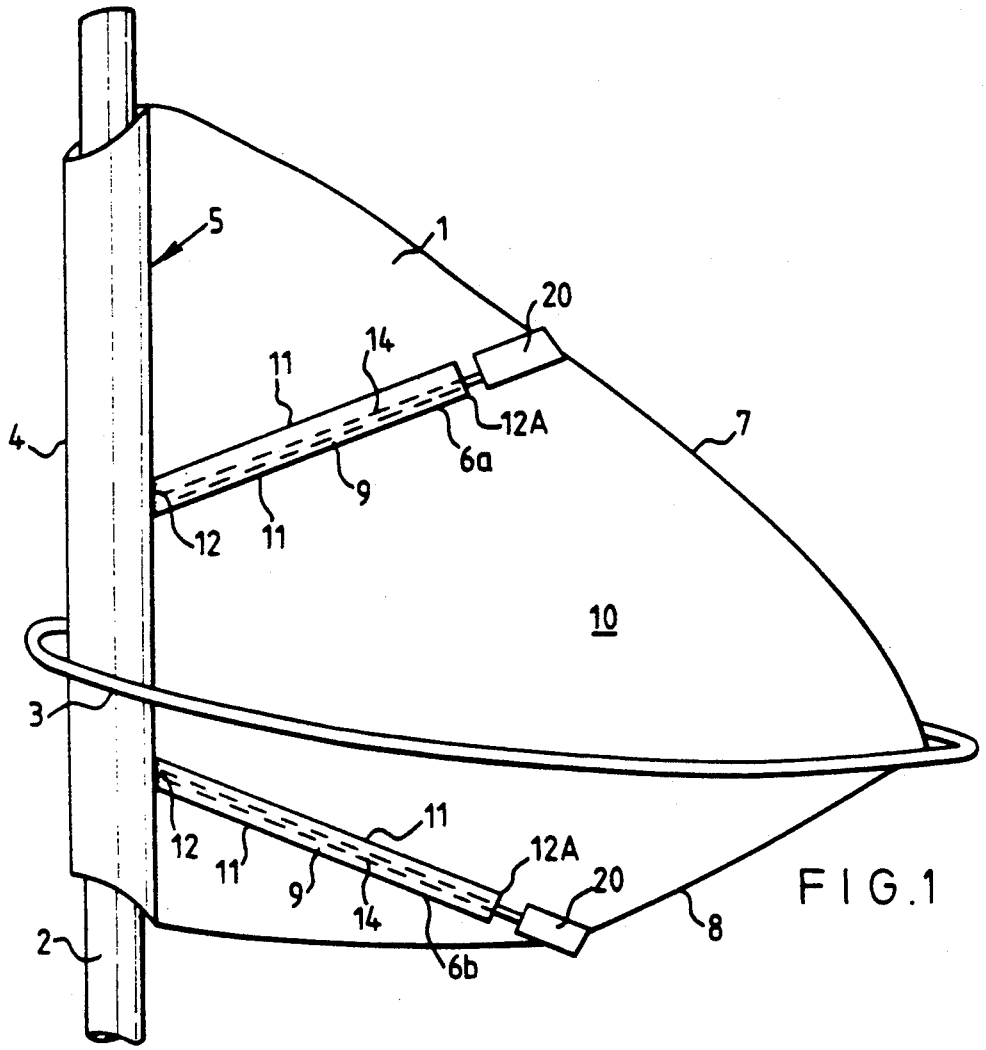
FIG. 1 is a schematic view of a sail incorporating a tensioning apparatus according to the invention.

In FIG. 1, a sail 1 for a sail board or windsurfer is mounted on a mast 2 in the usual fashion. Boom 3 serves to hold the sail out from the mast and act as a grip for the user. A sleeve 4 on the leading edge 5 of the sail encircles the mast 2 and straps or ropes (not shown) hold the sleeve and boom in position along the mast 2. Two elongate pockets 6*a*, 6*b* are formed on the sail and extend respectively from the trailing edge 7 to the leading edge 5, and from mid way along a bottom edge 8 to the leading edge 5.

Each pocket 6*a*, 6*b* is formed by a strip of material 9 which is sewn onto the main fabric 10 of the sail along longitudinal edges 11 and across their one ends 12. The pockets are each closed at one end 12, nearer the mast, and open at their other end 12A. Battens 14 fit into and extend along the length of each of the pockets 6*a* and 6*b*. An elongate opening closed by zip-fastener (not shown) may be provided along the centre of the strips 9 to allow access to the space enclosed between the sail fabric 10 and the material 9, that is the pocket. Tensioning apparatuses 20 shown here simply as blocks, which will be described in detail with reference to FIGS. 2 to 11, are provided adjacent the trailing edge and adjacent the bottom edge of the sail.

To tension the sail, the battens 14 are inserted in the pockets 6*a*, 6*b*. The battens are formed, for example, from laminated or pultruded FIBRE glass. The tensioning apparatus are then operated to urge the battens 14 firmly into the pockets and tension the sail.

It will be appreciated that the pockets may be wholly or partially open and formed by loops for example fixed at intervals across the sail to form together a pocket for the battens 14.

Figure 2:
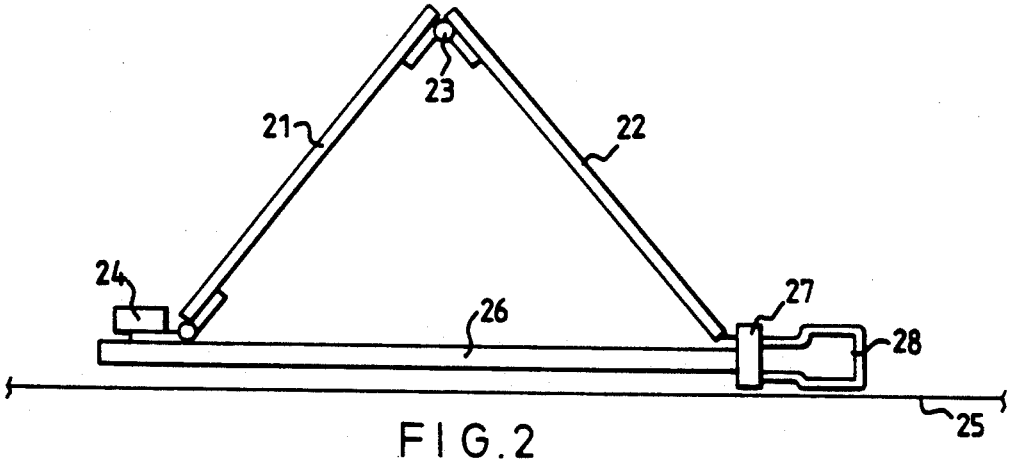
FIG. 2 is a schematic side view of the tensioning apparatus in its first operative position.

In FIG. 2, the tensioning mechanism, shown at 20 in FIG. 1. consists of two links 21 and 22 hinged by a hinge 23. The link 21 is also hinged to an anchor 24 which is secured to the surface of the sail 25 adjacent its trailing or lower edge. A bar 26 is generally constrained to move across the surface of the sail in alignment with its associated batten by loops (not shown) or similar sewn on to the sail. The bar 26 has a collar 27 and a cup-shaped end 28 for receiving the end of its associated batten. The bar 26 however may be substantially hollow so that the batten can enter inside to one third or, say, at least one half of the length of the bar 26 if preferred. The bar 26 could also be an end or extension of the batten itself fitted with a collar 27 for example.

In the position shown in FIG. 2, the batten 14 can be easily fitted into the pocket and an end of the batten placed in the end 28.

Figure 3:
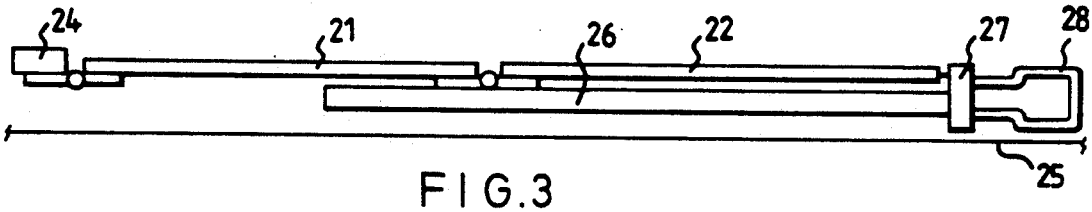
FIG. 3 is a schematic side of the tensioning apparatus in its second operative position.

Once the batten 14 is in position, the links 21 and 22 are pressed towards the surface of the sail 25, that is downwards in the FIG. 2, to the position shown in FIG. 3. As a result, the bar 26 moves to the left and urges the batten 14 firmly into the pocket and against the end of the pocket 13, and so tensions the sail.

To release the sail tension and to remove the batten, the links 21 and 22 are simply moved upwards in FIG. 3 so that they adopt the position shown in FIG. 2.

Figure 4:
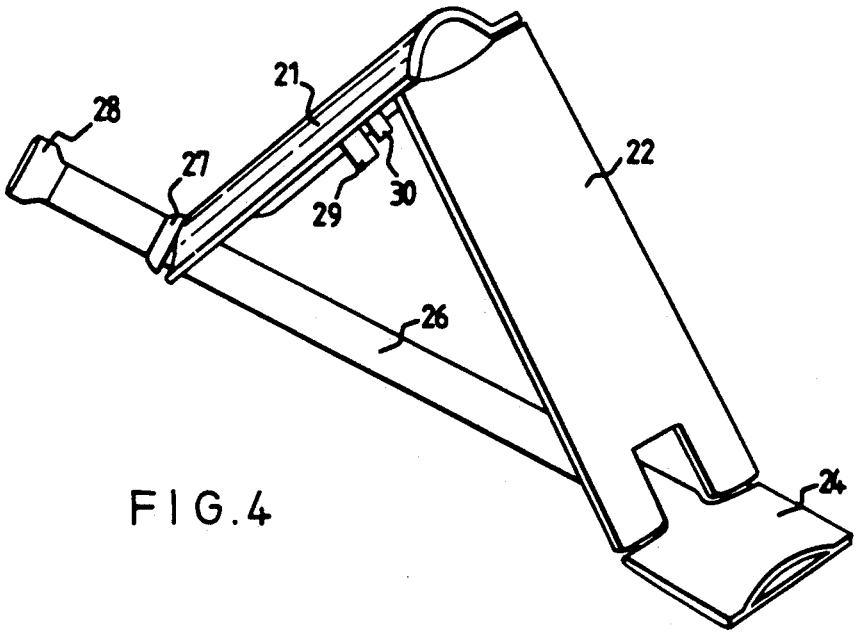
FIG. 4 is an isometric view of the tensioning apparatus in the first operative position.
Figure 5:
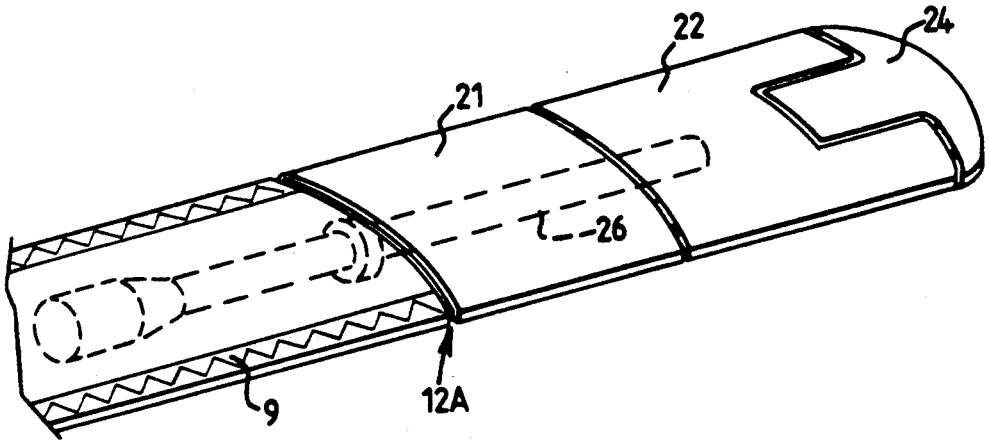
FIG. 5 is an isometric view of the tensioning apparatus in the second operative position.

FIGS. 4 and 5 show the tensioning mechanism of FIGS. 2 and 3, respectively, in a more practical form. It will be noted that locking arms 29 and 30 are shown on the link 21. The link 22 has similar locking arms which are not visible in these Figures. The locking arms resiliently press over the bar 26 when the links 21 and 22 are aligned with one another, in FIG. 4, to prevent the tensioning apparatus "collapsing", where the batten could move away from the end 12 and release tension on the sail. The locking arms are readily released however from the bar 26 if the links 21 and/or 22 are manually pressed upwards in the drawing, that is, away from the surface of the sail in practice.

Thus, the described tensioning apparatus consisting of simple and relatively inexpensive parts enables the battens to be easily inserted in the pockets, and more particularly provides quick and easy application of tension to the sail, and release of the tension when required. It will be appreciated that the tension may be adjusted by altering the effective length of the battens as is already in itself known, or by altering the effective length of the bar 26. This can be done by providing in the described arrangement a separate threaded end cup 28 or arranging for the collar 27 to be movable along the length of the bar and fixed in different positions.

Figure 6:
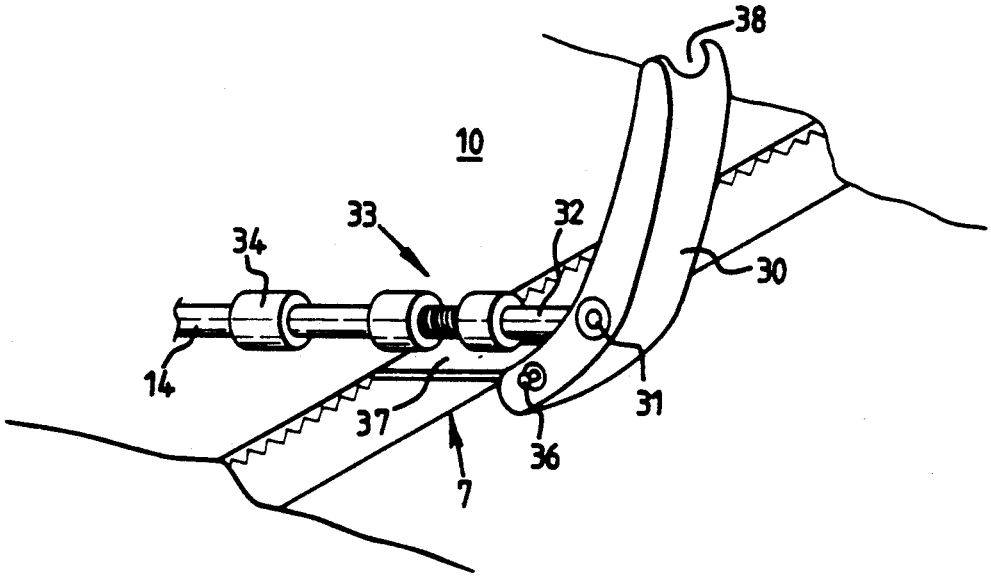
FIG. 6 is an isometric view of another tensioning apparatus according to the invention in its first operative position.

In FIG. 6, another locking mechanism comprises a handle 30 which is hingeable connected intermediate its ends by a rod 31 connected to a bar 32. The bar 32 extends through a length adjusting linkage 33 to a cup shaped end 34 for receiving the batten 14. An anchor for the lower end of the handle 30 is provided by a rod 36 held by webbing 57 sewn to the surface of the sail 10. When the handle is swung about the rod 36 towards the sail 10, the bar 32 is forced towards the batten 14 and urges the batten firmly into the pocket and against the end of the pocket 12 (FIG. 1). This action tensions the sail as required. A locking member 38, in the form of a shaped cut-out on the handle 30, engages over and locks to the bar 32 when the handle is pressed fully towards the surface of the sail. This prevents, except when the handle 30 is deliberately lifted away from the bar 32, the locking mechanism being inadvertently released or "collapsed".

As with the mechanism in FIGS. 2 to 5, the tension applied to the sail by the mechanism of FIG. 6 is adjustable by altering the threaded linkage 33 or by altering the effective length of the batten.

Figure 7:
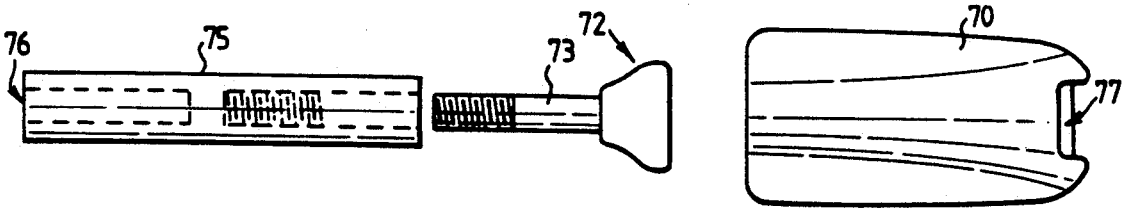
FIG. 7 to FIG. 11 are view of parts of a further tensioning device according to the invention.
Figure 8:
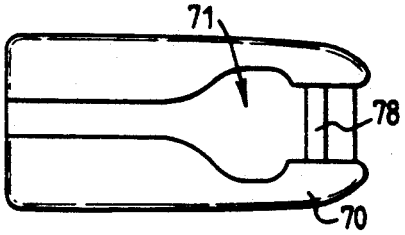

Referring to FIGS. 7 to 11, a tensioning device comprises three components which cooperate and fit together and are shown in an exploded view in FIG. 7. A handle 70 formed of moulded plastics material and shown also in FIGS. 8 and 9 has a cavity 71 formed in its underside to receive and surround a rearward end 72 of a pivoting arm 73. The forward end of the arm 73 is threaded and fits into a tube 75 which has an opening 76 to receive a sail batten (not shown). The handle 70, the arm 73 and the tube 76 are equivalent to the handle 30, the bar 32 with the linkage 33, and cup-shaped end 34, respectively in FIG. 6 and operate together in the same way.

The handle 70 is attached adjacent the trailing edge of a sail by a strip of webbing (not shown) which is stitched at one end to the surface of the sail. The strip of webbing is threaded through a slot 77 from an opening 78. The webbing is hemmed at its loose end to prevent the webbing passing completely through the opening 78. The strip of webbing provides where it is stitched to a sail the pivot about which the handle 70 swivels and when the rearward end 72 is placed in the cavity, and the batten is in the opening 76, swivelling of the handle 70 urges the batten against the end of the pocket 12, similarly as described in relation to the other embodiments to tension the sail. The tension applied to the sail can be adjusted by altering the effective overall length of the arm 73 and the tube 75 by screwing and unscrewing a threaded connection between them.

Figure 11:
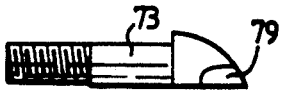

It will be noted that the effective pivoting axis between the handle 70 and the arm 73 is close to one side of the arm 73 (see FIG. 11). The pivot connection is effectively made between lips 79 and the opposing sides of the cavity 71. This means that there is only a minimum moment for any forces exerted by the sail tension to force open or collapse the tensioner by upwardly swivelling the handle part 70 away from the surface of the sail. Such moment is less than would be the case if the lips 79 were centrally or more upwardly positioned in FIG. 11 relative to the longitudinal axis of the part 73. When the tension is applied, the lips 79 and the under surface of the handle 70 are close to and adjacent the surface of the sail so keeping the moment to a minimum.

Figure 9:
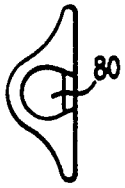
Figure 10:
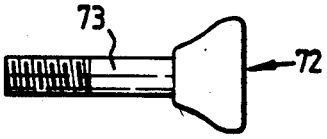

The handle 70 is made of somewhat resilient material and is provided with a generally cylindrical channel 80 (see FIG. 9). The bottom of the channel is open and can fit over the outside of the tube 75. In order to lock the tensioning device, the channel opening which is somewhat less wide than the diameter of the tube 75 is urged against the tube and springs open sufficiently to fit over the tube to thereafter lock the handle 70 firmly towards the surface of the sail. The tension in the sail is released by forcing the handle 70 away from the surface by the sail so that the channel 80 springs free of the tube 75 and then the handle 70 can swivel unhindered about the webbing stitching.

It will be appreciated, and as is clear from FIG. 7, that the arm 73 can be completely detached from the handle 70 when the tensioning device is in its collapsed configuration.

The described tensioning devices, which have been described as positioned adjacent the trailing edge and bottom edge of the sail, may be fitted to the leading edge of the sail if preferred.

We claim:

1. Tensioning apparatus for a sail comprising an elongate pocket closed at one end, a batten housed in the pocket, a collapsible hinged lever mechanism anchored to the sail adjacent the other end of the pocket, the mechanism being movable manually between first and second operative positions, in which in the first position the apparatus is loosely adjacent one end of the batten and in the second position the apparatus presses axially and firmly against one end of the batten to urge the batten longitudinally towards the said one end of the pocket to tension the sail, and locking means provided on the mechanism to releasably lock the mechanism in the second position.

2. Apparatus according to claim 1, wherein the pocket has a closable opening along its length for insertion of the batten.

3. Apparatus as claimed in claim 1, wherein the pocket is formed by an elongate strip of material attached to the sail to form the pocket therebetween.

4. Apparatus as claimed in claim 1, wherein the effective length of the batten is adjustable.

5. Apparatus according to claim 1, in which the mechanism comprises two link parts hinged together with one end link anchored to the sail and the other end link arranged to press towards the batten whenever the links are aligned with one another to tension the sail.

6. Apparatus according to claim 5 in which the locking means comprises locking arms which are arranged to releasably lock the links when in alignment.

7. Apparatus according to claim 6, in which the mechanism includes a central bar which is aligned with and at one end of the batten and over which bar the locking arms engage.

8. Apparatus according to claim 5 in which the mechanism includes a central bar which is aligned with and at one end of the batten including a collar provided on the bar against which the sail other end link bears to tension the sail.

9. Apparatus according to claim 1 in which the mechanism includes a bar generally aligned with and having its first end at one end of the batten, a hinged connection between the other end of the bar and an intermediate part of a handle which is hinged to pivot about its end anchored to the sail, whereby when the handle is swung towards the sail the bar is moved to urge the batten towards the other end of the pocket.

10. Apparatus according to claim 9, in which the bar and the handle can be completely separated from one another when the apparatus is in a collapsed configuration.

11. Apparatus according to claim 10, in which the locking means comprises a locking member on the handle to releasably lock against the bar.

12. Apparatus according to claim 9, in which the locking means comprises a locking member on the handle to releasably lock against the batten.

13. Tensioning apparatus for a sail comprising a collapsible hinged lever mechanism which is arranged to be anchored to the sail adjacent one end of a batten pocket which is closed at one end and open at the other end, the mechanism being movable manually between first and second operative positions, in which in the first position the apparatus is loosely adjacent one end of the batten and in the second position the apparatus presses axially and firmly against the one end of the batten to urge the batten against the said one end of the pocket and tension the sail, and locking means provided on the lever mechanism to releasably lock the mechanism in the second position.

14. Apparatus according to claim 7, in which the effective length of the bar is adjustable.

15. Apparatus according to claim 9, in which the effective length of the bar is adjustable.

16. Apparatus according to claim 9, including a tube for connecting between the bar and the batten including a threaded connection to connect the bar to the tube arranged to adjust the effective overall length of the bar and the tube.

17. Apparatus according to claim 16, in which the locking means comprises a locking member on the handle to releasably lock the handle to the tube.

* * * * *